US010414564B2

(12) United States Patent
Shively

(10) Patent No.: US 10,414,564 B2
(45) Date of Patent: Sep. 17, 2019

(54) BOTTLE CAP RETAINER

(71) Applicant: Drew Michael Shively, Aurora, CO (US)

(72) Inventor: Drew Michael Shively, Aurora, CO (US)

( * ) Notice: Subject to any disclaimer, the term of this patent is extended or adjusted under 35 U.S.C. 154(b) by 767 days.

(21) Appl. No.: 14/958,400

(22) Filed: Dec. 3, 2015

(65) Prior Publication Data

US 2017/0158398 A1 Jun. 8, 2017

(51) Int. Cl.
*B65D 55/00* (2006.01)
*B65D 55/16* (2006.01)

(52) U.S. Cl.
CPC ..... *B65D 55/16* (2013.01)

(58) Field of Classification Search
CPC ..... B65D 55/16
USPC ..... 215/306
See application file for complete search history.

(56) References Cited

U.S. PATENT DOCUMENTS 1,041,816 A * 10/1912 Kopald ..... B65D 55/16 215/306
1,329,184 A * 1/1920 Hyams ..... B65D 25/48 222/538
1,430,843 A * 10/1922 Paull ..... B65D 35/42 220/292
1,771,644 A 7/1930 MacCordy
1,924,242 A * 8/1933 Kaye ..... B65D 55/16 215/306
2,581,849 A * 1/1952 Fisch ..... B65D 35/42 220/288
2,789,717 A * 4/1957 Demke ..... B65D 55/16 215/235
3,306,483 A 2/1967 Bellafiore
D243,062 S * 1/1977 Malloy ..... D8/382
4,339,056 A * 7/1982 Berkstresser, Jr. .... B65D 55/16 220/375
4,534,483 A * 8/1985 Kassis ..... B65D 55/16 206/509

(Continued)

FOREIGN PATENT DOCUMENTS

JP 2007-015758 1/2007

OTHER PUBLICATIONS

"Genuine 58 Pattern Water Bottle Cap Retainer", Cadet Direct, Retrieved on Aug. 14, 2015, from http://www.cadetdirect.com/genuine-58-pattern-water-bottle-cap-retainer, 2 pages.

(Continued)

*Primary Examiner* — Ernesto A Grano
(74) *Attorney, Agent, or Firm* — Kilpatrick Townsend & Stockton LLP

(57) ABSTRACT

A retainer for a bottle cap. In one implementation, the retainer includes a first connector at a first end, the first connector being made of a first elastic material. The first connector defines a first opening having an inner perimeter sized to be captured in a groove in a particular bottle in a slip fit. The retainer also includes a second connector at a second end, the second connector being made of a second elastic material. The second connector defines a second opening having an inner perimeter sized to receive an outer perimeter of a cap of the particular bottle in an interference fit. The retainer further includes a flexible elongate strap joining the first and second connectors.

11 Claims, 6 Drawing Sheets

(56) References Cited

U.S. PATENT DOCUMENTS 5,102,002 A * 4/1992 Whitley ..... A47G 19/2205 220/287
5,150,808 A * 9/1992 Hamilton ..... B60K 15/0406 220/255
D356,260 S * 3/1995 Frank ..... D9/446
5,518,136 A * 5/1996 Muldner ..... B65F 1/06 220/495.11
5,613,657 A 3/1997 Olaiz
6,302,286 B1 * 10/2001 Witherspoon ..... A61J 11/008 215/11.1
6,370,701 B1 * 4/2002 Siegrist ..... A47K 11/12 4/144.1
6,409,220 B1 * 6/2002 Wing ..... A61M 1/0001 128/912
6,478,180 B1 * 11/2002 Dehn, Sr. ..... B65D 47/061 215/276
6,565,743 B1 5/2003 Poirier et al.
6,622,356 B2 * 9/2003 Doshi ..... F16G 11/02 220/203.09
D514,432 S * 2/2006 McLaughlin ..... D8/356
7,073,686 B2 * 7/2006 Hanell ..... B67B 7/26 220/267
D541,943 S * 5/2007 Stewart ..... D24/199
D593,856 S 6/2009 Kubler
D601,311 S * 9/2009 DeSeguirant, Jr. ..... D30/160
D605,942 S * 12/2009 Miksovsky ..... D9/446
D614,440 S * 4/2010 Cresswell ..... D7/392.1
7,748,579 B1 * 7/2010 Shin ..... B65D 83/06 222/444
8,245,870 B2 * 8/2012 McKinney ..... A47G 19/2266 215/306
D682,017 S * 5/2013 Smiedt ..... D7/392.1
8,443,994 B1 5/2013 Desselle
8,528,764 B2 9/2013 Chapple et al.
8,752,720 B1 * 6/2014 Habig ..... B65D 55/16 215/306
8,926,840 B2 * 1/2015 Hull ..... A47G 19/2266 210/282
D724,380 S * 3/2015 Hojo ..... D7/396.2
D753,998 S * 4/2016 Murphey ..... D9/446
9,656,191 B2 * 5/2017 Hull ..... B01D 29/21
D797,555 S * 9/2017 Carlson ..... D9/436
D806,893 S * 1/2018 Finley ..... D24/231
D809,060 S * 1/2018 Zhang ..... D19/194
2004/0164079 A1 * 8/2004 Alois ..... B65D 39/0005 220/375
2005/0109725 A1 * 5/2005 Stewart ..... A61J 11/008 215/11.6
2005/0199631 A1 * 9/2005 Alois ..... B65D 39/0005 220/375
2006/0016819 A1 * 1/2006 Paslawski ..... B65D 1/0292 220/666
2006/0096987 A1 * 5/2006 Wry ..... A47G 23/0266 220/375
2007/0199914 A1 * 8/2007 Hung ..... B65D 47/243 215/311
2009/0134112 A1 * 5/2009 Reeves ..... A61J 11/008 215/11.6
2009/0145915 A1 * 6/2009 Huff ..... B65D 55/16 220/744
2009/0194531 A1 * 8/2009 Branco ..... A47G 19/2205 220/23.83
2016/0256359 A1 * 9/2016 Trawick ..... A61J 9/085
2017/0127859 A1 * 5/2017 Hornung ..... A47G 19/2266
2018/0029762 A1 * 2/2018 Eyal ..... B65D 55/16
2018/0153288 A1 * 6/2018 Campbell ..... A45F 5/10

OTHER PUBLICATIONS

"Genuine 58 Pattern Water Bottle & Mug", Cadet Direct, Retrieved on Aug. 14, 2015, from http://www.cadetdirect.com/genuine-58-pattern-water-bottle-mug, 2 pages.
"DIY Gatorade Cap Keeper", Instructables, Copyright 2015, Retrieved on Aug. 14, 2015 from http://instructables.com/id/DIY-Gatorade-Cap-Keeper/, 4 pages.
"Make Your Own Gear—DIY Water Bottle and Freezer Bag Cozy Projects", Backpacking Light: Forum Index, Posted on Jan. 24, 2011, Copyright 2003-2014, Retrieved on Aug. 14, 2015 from http://backpackinglight.com/cgi-bin/backpackinglight/forums/thread_display.html?forum_thread_id=42001, 3 pages.
Author Uknown, Admitted Prior Art, No date, 1 page.

* cited by examiner

BOTTLE CAP RETAINER

BACKGROUND OF THE INVENTION

Water and other beverages are often supplied in plastic bottles similar to bottle 100 shown in FIG. 1. Bottle 100 includes a main body 101 and a cap 102 that can be unscrewed from main body 101 to open bottle 100. Cap 102 can also be screwed back onto main body 101 to close bottle 100, for example to preserve remaining liquid in bottle 100 after some of the bottle contents have been consumed. Main body 101 may be made, for example, of a plastic such as polyethylene terephthalate (PET), and may be recyclable.

FIG. 2 shows a more detailed view of the upper portion of bottle 100 after cap 102 has been unscrewed from main body 101 via threads 201, exposing spout 202 through which a user can drink or pour liquid. In this kind of bottle, cap 102 is completely detachable from main body 101. Once detached, cap 102 may be easily dropped, lost, or misplaced, resulting in inconvenience for the user of bottle 101 and increasing the risk of spillage.

BRIEF SUMMARY OF THE INVENTION

According to one aspect, a retainer for a bottle cap comprises a first connector at a first end of the retainer. The first connector is made of a first elastic material and defines a first opening having an inner perimeter sized to be captured in a groove in a particular bottle in a slip fit. The retainer further comprises a second connector at a second end of the retainer. The second connector is made of a second elastic material and defines a second opening having an inner perimeter sized to receive an outer perimeter of a cap of the particular bottle in an interference fit. The retainer further comprises a flexible elongate strap joining the first and second connectors.

DETAILED DESCRIPTION OF THE INVENTION

Embodiments of the invention provide a convenient device and method for retaining a detachable bottle cap with its associated bottle body, thus reducing the risk of loss of the bottle cap.

Figure 1:
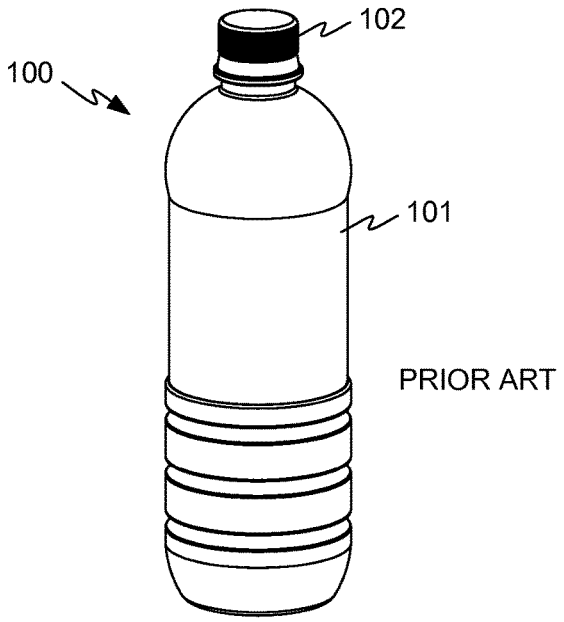
FIG. 1 illustrates a bottle.
Figure 2:
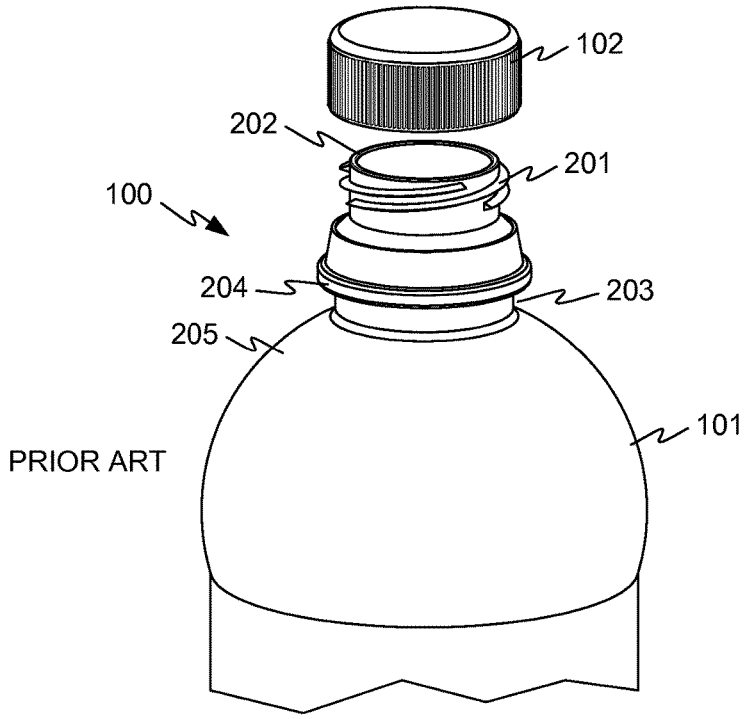
FIG. 2 illustrates the bottle of FIG. 1, with its cap removed.

Referring again to FIG. 2, example bottle defines a groove 203 near spout 202. Groove 203 is an area of reduced diameter (or other girth) as compared with the adjacent portions of bottle 100. That is, in example bottle 100, the portions 204 and 205 immediately above and below groove 203 are of larger diameter than groove 203.

Figure 3:
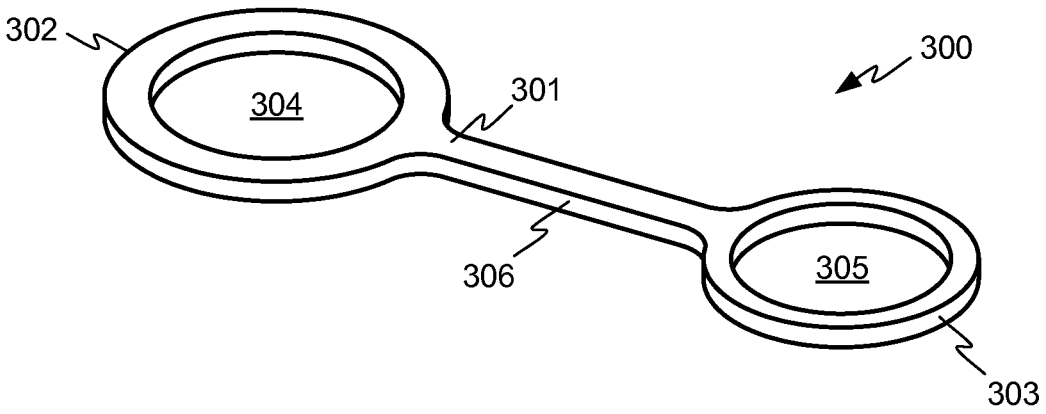
FIG. 3 illustrates a perspective view of a bottle cap retainer in accordance with embodiments of the invention.

FIG. 3 illustrates a bottle cap retainer 300 in accordance with embodiments of the invention. Example bottle cap retainer 300 includes a body 301 having a first end 302 and a second end 303. Body 301 is made of an elastic material.

For the purposes of this disclosure and "elastic" material is one that is rubber-like in consistency, and can be significantly deformed by moderate hand pressure and returns essentially to its unstressed shape once pressure is removed. Examples of elastic materials include natural or synthetic rubber, urethane, neoprene, or similar materials. In some embodiments, the material of body 301 may have a hardness of about 0 to 60 as measured on the Shore A scale, and preferably has a Shore A hardness of about 0 to 30. In some embodiments, body 301 has a hardness and elasticity comparable to that of a common office rubber band. Examples of materials that are not considered to be elastic for the purposes of this disclosure are hard polymers such as polycarbonate, ABS, and similar materials.

First end 302 of bottle cap retainer 300 defines an opening 304. The inner perimeter of opening 304 is sized to be captured in a groove in a bottle with which bottle cap retainer 300 is to be used, and to be slightly larger than the minimum size of the groove. For example, in a bottle cap retainer 300 to be used with bottle 100, the inner diameter of opening 304 would be somewhat larger than the minimum diameter of groove 203, but would be smaller than the diameters of the portions 204 and 205 of bottle 100 on either side of groove 203.

Similarly, second end 303 of body 301 defines an opening 305 sized to be somewhat smaller than a bottle cap with which bottle cap retainer 300 is to be used. For example, in a bottle cap retainer 300 to be used with bottle 100, the inner diameter of opening 305 would be somewhat smaller than the maximum diameter of cap 102. Ends 302 and 303, along with their associated openings 304 and 305 may be considered to be connectors.

Finally, body 301 also includes a flexible elongate strap 306 between first and second ends 302 and 303. It will be appreciated that bottle cap retainer 300 may be efficiently made by die cutting or stamping from a thin sheet of elastic material, although a cap retainer according to embodiments of the invention may be made in other ways as well, for example laser or water jet cutting, 3D printing, or another method.

Figure 4:
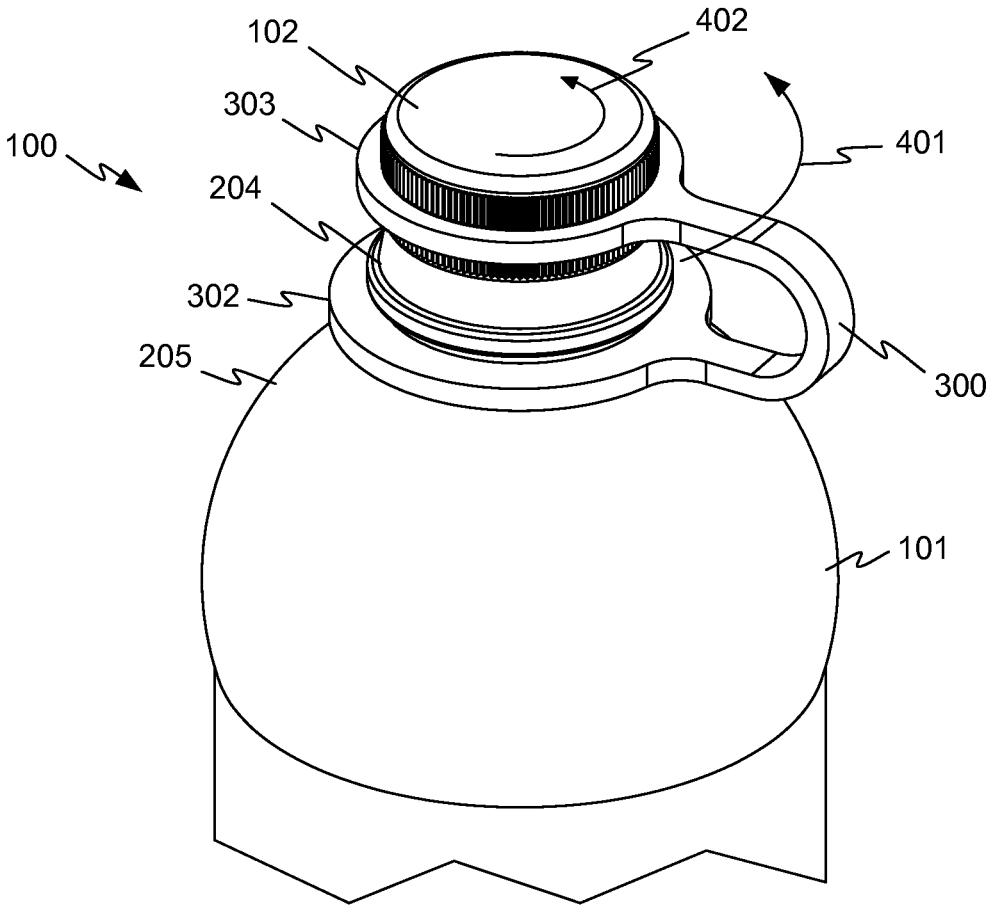
FIG. 4 illustrates the bottle cap retainer of FIG. 3 in position on the bottle of FIG. 1.

FIG. 4 illustrates bottle cap retainer 300 in position on bottle 100. To reach this configuration, first end 302 may be placed downward over cap 102 and stretched over portion 204 of bottle 100 until groove 203 is reached, at which point first end 302 is allowed to return to its unstretched size. First end 302 is thus captured within groove 203, because opening 304 is smaller than the adjacent portions of bottle 100.

However, opening 304 is also larger than the minimum diameter of groove 203, so first end 302 fits loosely within groove 203. That is, first end 302 engages groove 203 in a slip fit. Bottle cap retainer 300 is free to rotate with respect to main body 101 of bottle 100, as is shown by arrow 401, while remaining captured in groove 203.

Second end 303 of bottle cap retainer 300 is engaged with cap 102 by stretching second end 302 over cap 102 and allowing second end 302 to retract toward its unstretched size. However, because cap 102 is larger than opening 305, second end 303 squeezes against cap 102. That is, second end 303 engages cap 102 in an interference fit.

Bottle cap retainer 300 may be installed in this manner before bottle 100 is opened, but this is not a requirement.

Figure 5:
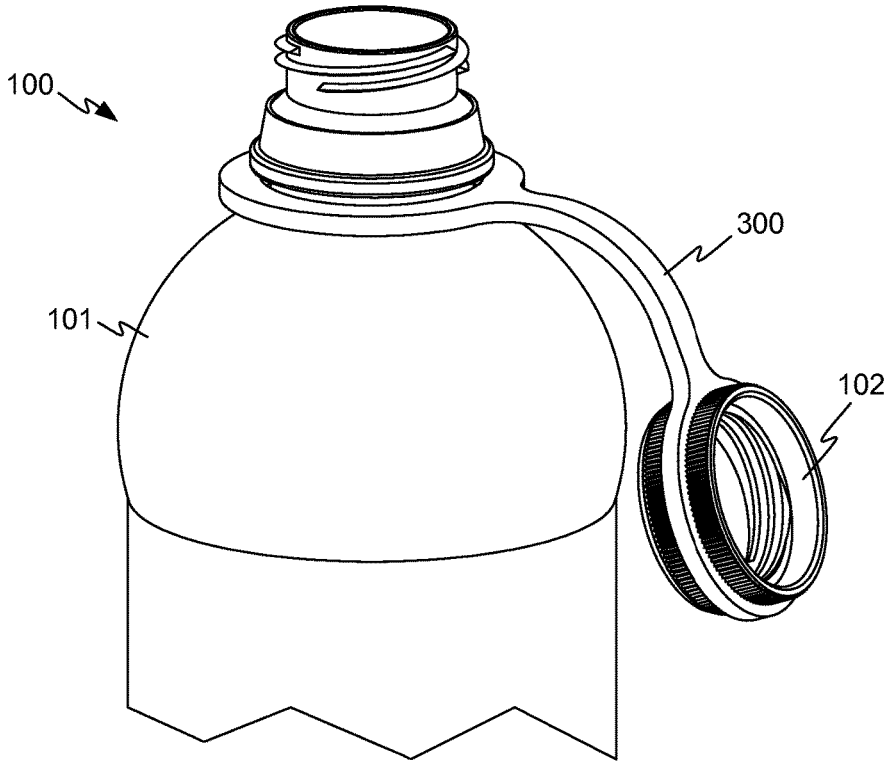
FIG. 5 illustrates the bottle of FIG. 1 with its cap removed, and being retained to the bottle by the bottle cap retainer of FIG. 3.

To open bottle 100, cap 102 and bottle cap retainer 300 are rotated together as illustrated by arrows 401 and 402. Bottle cap retainer 300 turns with cap 102 by virtue of its interference fit with cap 102, but turns freely within groove 203 by virtue of its slip fit in groove 203. Cap 102 can thus be removed from main body 101 of bottle 100, but remains connected to main body 101 by retainer 300, as is shown in FIG. 5. Retainer 300 may greatly reduce the chance of inadvertent loss of cap 102.

Cap 102 can be replaced onto main body 101 with retainer 300 in place by simply reversing the process of removal.

Figure 6:
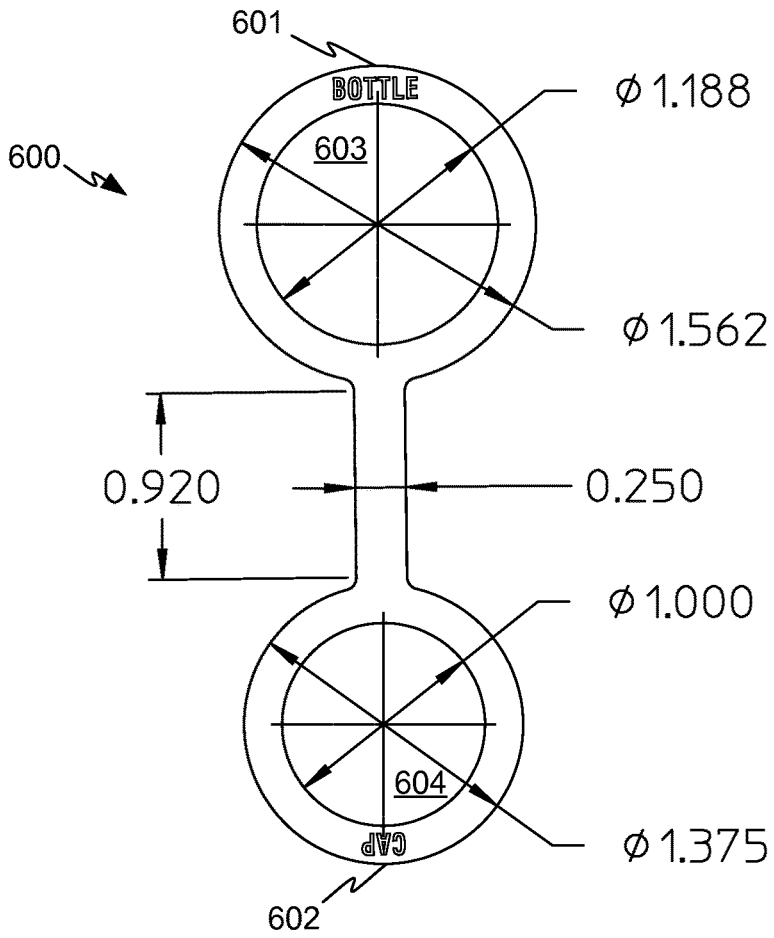
FIG. 6 illustrates an orthogonal view of a bottle cap retainer in accordance with embodiments of the invention.

Referring again to FIG. 2, in one common bottle design, groove 203 has a diameter of about 1.030 inches at its throat, portion 204 is a ridge having an outer diameter of about 1.300 inches at its widest point, and cap 102 has an outer diameter of about 1.190 inches. FIG. 6 illustrates a dimensioned drawing of one specific example retainer 600 designed to accommodate these bottle dimensions. First end 601 defines an opening 603 sized for a slip fit about groove 203, and second end 602 defines an opening 604 sized for an interference fit around cap 102. That is, the inner diameter of opening 603 is larger than the throat diameter of groove 203, and the inner diameter of opening 604 is smaller than the outer diameter of cap 102. Example retainer 600 may be about 0.0625 inches thick.

While FIG. 6 illustrates one example retainer 600 for use with one particular bottle, it is only an example, and it is intended that bottle cap retainers having other dimensions be encompassed by the appended claims.

Figure 7:
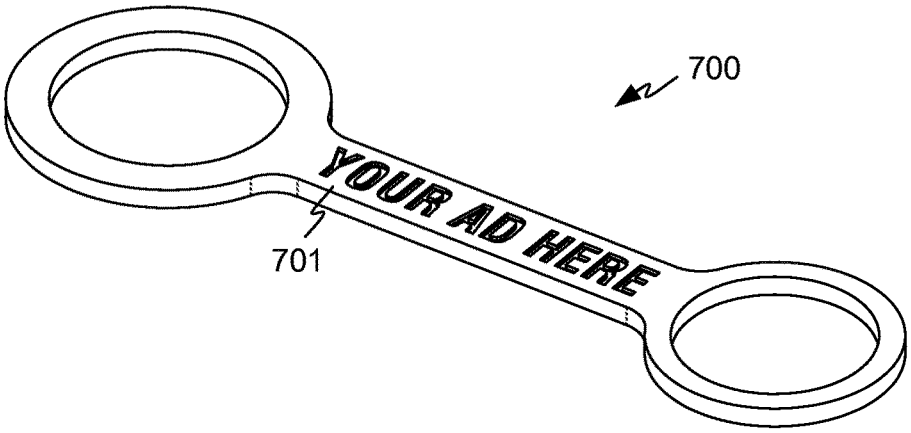
FIG. 7 illustrates a bottle cap retainer in accordance with other embodiments of the invention.

In some embodiments, a bottle cap retainer may include a surface suitable for the placement of text, pictures, advertising, or other indicia. For example, FIG. 7 illustrates a bottle cap retainer 700 having text embossed, printed, painted, raised, or otherwise shown on surface 701. Bottle cap retainers including advertising such as bottle cap retainer 700 may be distributed, for example, as giveaway items at trade shows, conferences, and the like, for marketing purposes, but other distribution methods are also envisioned.

While embodiments have been described above as being used with a round bottle having a round cap, this is not a requirement. Other embodiments may be used with bottles of other shapes, so long as the body of the bottle defines a groove that can capture one end of a bottle cap retainer in a slip fit, and a cap that can be captured in the other end of the bottle cap retainer in an interference fit.

And while the bottle cap retainer embodiments discussed above are each made of a monolithic piece of elastic material, this is also not a requirement. For example, the two ends of a bottle cap retainer may be made of separate pieces, even of different materials, and the flexible elongate strap may be separate from one or both of the ends and joined to either or both ends using an adhesive, rivets, or other techniques. In other embodiments, the flexible elongate strap need not be flat, but may be round in cross section, oval in cross section, or may have another shape.

Figure 8:
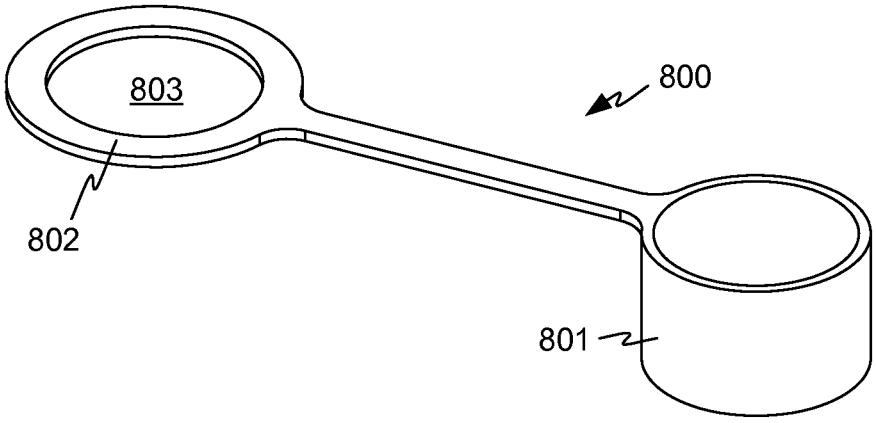
FIG. 8 illustrates a bottle cap retainer in accordance with other embodiments of the invention.

In the example bottle cap retainers described above, each of the ends of the retainer defines a through hole that functions as a connector. In other embodiments, different shapes may be used. FIG. 8 illustrates a bottle cap retainer 800 in accordance with another embodiment, in which the connector 801 for engaging the cap of a bottle is cup-shaped, and does not define a through hole. The inside diameter of connector 801 is sized for an interference fit with the cap of a bottle with which retainer 800 is to be used. A second connector 802 for engaging a groove in the bottle may still define a through hole 803, sized for a slip fit in the groove in the bottle.

Figure 9:
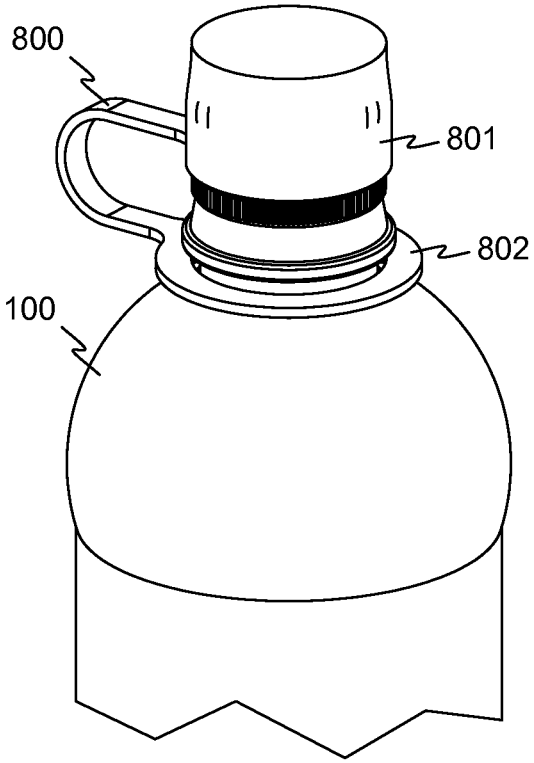
FIG. 9 illustrates the bottle cap retainer of FIG. 8 in position on a bottle.

FIG. 9 illustrates example bottle cap retainer 800 in place on bottle 100.

In other embodiments, a bottle cap retainer may include decorative or other features. For example, a bottle cap retainer embodying the invention may be any color or combination of colors, which may be selected for purely aesthetic reasons, to match the color scheme of a particular commercial logo or brand, or for other reasons.

Figure 10:
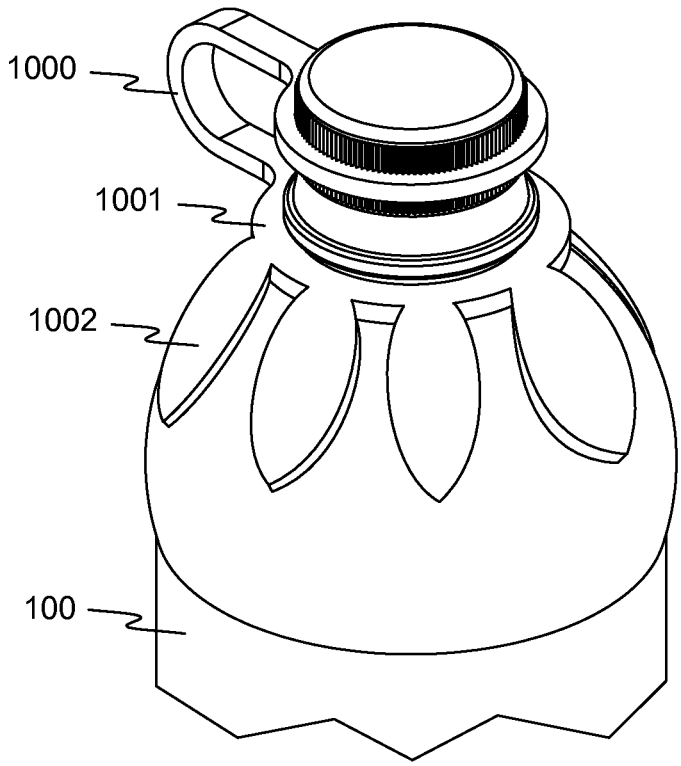
FIG. 10 illustrates a bottle cap retainer in accordance with other embodiments of the invention.

In some embodiments, decorative or fanciful shapes, colors, or both may be used. For example, FIG. 10 illustrates a bottle cap retainer 1000 in which the connector 1001 engaging bottle 100 is shaped like leaves or flower petals 1002. In other embodiments, portions of a bottle cap retainer may be shaped like a character, a person, a sports team mascot, an article of clothing, or another item.

It is to be understood that any workable combination of the features and capabilities disclosed above in the various embodiments is also considered to be disclosed.

The invention has now been described in detail for the purposes of clarity and understanding. However, those skilled in the art will appreciate that certain changes and modifications may be practiced within the scope of the appended claims.

What is claimed is:

1. A container system, comprising:

a bottle for containing a liquid, the bottle comprising:

a bottle body having spout and defining a groove in a perimeter of the bottle, the groove bounded by a first larger portion of the bottle and a second larger portion of the bottle, the first larger portion of the bottle positioned between the spout and the groove and the second larger portion of the bottle positioned distally from the spout in relation to the groove; and a cap configured to engage the spout to close the bottle, the cap having an outer perimeter and the cap being completely detachable from the bottle, wherein the cap has substantially straight sides; and a retainer, the retainer comprising:

a first connector at a first end of the retainer, the first connector being made of a first elastic material and defining a first opening having an inner perimeter captured within the groove in a slip fit;

a second connector at a second end of the retainer, the second connector being made of a second elastic material and defining a second opening having an inner perimeter receiving the outer perimeter of the cap in an interference fit; and a flexible elongate strap joining the first connector and the second connector;

wherein both the first opening and the second opening are circular, and wherein the diameter of the second opening is at least 50 percent of the diameter of the first opening;

and wherein the cap is retained to the body of the bottle by virtue of the second connector squeezing against the sides of the cap.

2. The container system of claim 1, wherein both the first opening and the second opening are through holes.

3. The container system of claim 1, wherein the first elastic material and the second elastic material are the same, and the retainer is a monolithic piece of the elastic material.

4. The container system of claim 1, wherein both the first larger portion of the bottle and the second larger portion of the bottle have perimeters larger than the outer perimeter of the cap.

5. The container system of claim 1, wherein the second connector is cup-shaped and is sized to receive the cap within the cup shape, and wherein the second connector does not include a through hole.

6. The container system of claim 1, wherein the groove has a diameter at its throat smaller than a diameter of the cap.

7. The container system of claim 1, wherein the diameter of the second opening is at least 80 percent of the diameter of the first opening.

8. A method, comprising:

obtaining a bottle for containing a liquid, the bottle comprising a spout and the bottle defining a groove in a perimeter of a body of the bottle, the groove bounded by a first larger portion of the bottle and a second larger portion of the bottle, the first larger portion of the bottle positioned between the spout and the groove and the second larger portion of the bottle positioned distally from the spout in relation to the groove, wherein the bottle includes a cap configured to engage the spout to close the bottle, the cap having an outer perimeter and the cap being completely detachable from the bottle, wherein the cap has substantially straight sides;

obtaining a retainer, the retainer including a first connector at a first end of the retainer and a second connector at a second end of the retainer, the first connector being made of a first elastic material and defining a first opening having an inner perimeter sized to be captured within the groove in a slip fit and the second connector being made of a second elastic material and defining a second opening having an inner perimeter sized to receive the outer perimeter of the cap in an interference fit, wherein the first connector and the second connector are joined by a flexible elongate strap, wherein both the first opening and the second opening are circular, and wherein the diameter of the second opening is at least 50 percent of the diameter of the first opening;

passing the first connector over and past the spout of the bottle;

stretching the first connector over and past the first larger portion of the bottle to capture the first connector in a slip fit within the groove; and stretching the second connector over the outer perimeter of the cap to capture the cap in an interference fit within the second connector, such that the cap is retained to the body of the bottle by virtue of the second connector squeezing against the sides of the cap.

9. The method of claim 8, wherein both the first opening and the second opening are through holes.

10. The method of claim 8, wherein the first elastic material and the second elastic material are the same, and the retainer is a monolithic piece of the elastic material.

11. The method of claim 8, wherein the diameter of the second opening is at least 80 percent of the diameter of the first opening.

* * * * *